US007796097B2

(12) United States Patent
Suzuki et al.

(10) Patent No.: US 7,796,097 B2
(45) Date of Patent: Sep. 14, 2010

(54) PLASMA DISPLAY PANEL

(75) Inventors: Masanori Suzuki, Osaka (JP); Nobutaka Hokazono, Osaka (JP); Kentaro Ueda, Osaka (JP); Toshifumi Nagino, Osaka (JP)

(73) Assignee: Panasonic Corporation, Osaka (JP)

( * ) Notice: Subject to any disclaimer, the term of this patent is extended or adjusted under 35 U.S.C. 154(b) by 612 days.

(21) Appl. No.: 11/795,838

(22) PCT Filed: Dec. 27, 2006

(86) PCT No.: PCT/JP2006/026001

§ 371 (c)(1),
(2), (4) Date: Jul. 23, 2007

(87) PCT Pub. No.: WO2007/077853

PCT Pub. Date: Jul. 12, 2007

(65) Prior Publication Data

US 2008/0129655 A1 Jun. 5, 2008

(30) Foreign Application Priority Data

Dec. 27, 2005 (JP) ..... 2005-374458

(51) Int. Cl.
*G09G 3/28* (2006.01)

(52) U.S. Cl. ..... 345/60; 313/582

(58) Field of Classification Search ..... 345/40–43, 345/60–72, 103, 204; 313/582, 584–585, 313/46–47, 49; 315/169.4
See application file for complete search history.

(56) References Cited

U.S. PATENT DOCUMENTS

| | | | | |
|---|---|---|---|---|
| 5,661,500 | A * | 8/1997 | Shinoda et al. | 345/60 |
| 7,220,653 | B2 | 5/2007 | Lee et al. | |
| 7,679,288 | B2 * | 3/2010 | Song et al. | 313/582 |
| 2002/0042025 | A1 | 4/2002 | Tokai et al. | |

FOREIGN PATENT DOCUMENTS

| | | |
|---|---|---|
| JP | 8-45823 | 2/1996 |
| JP | 10-64782 | 3/1998 |
| JP | 11-242340 | 9/1999 |

(Continued)

*Primary Examiner*—Richard Hjerpe
*Assistant Examiner*—Mansour M Said
(74) *Attorney, Agent, or Firm*—Wenderoth, Lind & Ponack, L.L.P.

(57) ABSTRACT

A plasma display panel which includes a front panel having a front substrates on which display electrodes each having a scan electrode and a sustain electrode disposed to each other with a discharge gap in between are provided in a plurality of columns; and a rear panel having a rear substrate disposed opposed to the front substrate, on which rear substrate barrier ribs for dividing a discharge space formed with respect to front panel are formed, an data electrode is disposed between the barrier ribs crosswise to the display electrodes, and a phosphor layer is disposed between the barrier ribs. Rear panel is split into a plurality of areas along the direction parallel to the data electrode and barrier ribs are formed for each of the split areas, an alignment mark is provided in a place out of the display region at the splitting border of rear panel, and an insulation layer covering data electrode is provided with a cut to have the alignment mark disclosed.

2 Claims, 7 Drawing Sheets

FOREIGN PATENT DOCUMENTS

| | | |
|---|---|---|
| JP | 2000-30607 | 1/2000 |
| JP | 2000-268722 | 9/2000 |
| JP | 2001-125284 | 5/2001 |
| JP | 2002-117756 | 4/2002 |
| JP | 2003-16926 | 1/2003 |
| JP | 2003-131580 | 5/2003 |
| JP | 2005-85690 | 3/2005 |
| KR | 10-2004-0107063 | 12/2004 |
| KR | 10-2005-0052273 | 6/2005 |

* cited by examiner

PLASMA DISPLAY PANEL

TECHNICAL FIELD

The present invention relates to a plasma display panel which is used as a display device of a plasma display apparatus.

BACKGROUND ART

Panels of plasma display apparatus have been categorized into an AC type and a DC type in terms of the method of driving, and a surface discharge type and an opposed discharge type in terms of the pattern of discharge. Nowadays, three-electrode surface discharge type is the main stream among the plasma display panels, because of its advantages in implementing a higher definition display, a larger display area and the simple manufacturing procedure.

The surface discharge type plasma display panel includes a pair of substrates, at least the front side of which pair substrates being transparent, which are disposed opposed so as a discharge space is formed between the pair substrates, and barrier ribs provided on the substrate for dividing the discharge space into plural discharge spaces. A group of electrodes are provided on the substrate for causing electric discharge in the discharge spaces formed by the barrier ribs, and phosphors are provided for emitting the red, green and blue light upon the discharge. Thus, a plurality of discharge cells are formed. Short-wavelength ultraviolet ray generated by the discharge in vacuum excites the phosphors, and the discharge cells emit the red, green and blue visible lights, respectively, for a display in color.

In comparison with the liquid crystal display panels, plasma display panels are highly appreciated among the flat panel displays because of the higher display speed, wider viewing angle, manufacturing ease in providing larger-size displays, high display image quality intrinsic to the self-emitting type, and other advantages. So, the plasma display apparatus is used increasingly as a display for mass audience in the general public, as well as at home for a family who enjoys lively images on a large screen.

In the plasma display apparatus, the panel made of a glass as the main material is held at the front of a metal chassis made of e.g. aluminum, while circuit boards for driving the panel to emit the lights are disposed behind the chassis. Thus a plasma display device is offered in the form of a module (ref. Patent Document 1).

Taking advantage of the easiness in manufacturing the large-size screens, the plasma display devices larger than 65 inch size are already in the general market. Along with the increasing demands for display in the higher definition, the conventional display definition of 768×1366 is shifting a higher definition screen of 1080×1920. Plasma display panels of the higher definition are already in production.

As the result of progress with plasma display panels towards the larger screen sizes and the display at higher definition level, the constituent components are requested to be thoroughly restudied.

[Patent Document 1] Japanese Patent Unexamined Publication No. 2003-131580

SUMMARY OF THE INVENTION

Based on the above-described background in the industry, the present invention aims to offer a plasma display panel that is suitable for a larger-size display at a higher definition level.

A plasma display panel in the present invention includes a front panel having display electrodes including a first electrode and a second electrode provided opposed to each other with a discharge gap therebetween in a plurality of columns on a front substrate. A rear panel has a rear substrate disposed opposed to the front substrate, and the rear substrate is provided with barrier ribs disposed in parallel crosses for dividing a discharge space formed with respect to the front panel, data electrodes disposed between the barrier ribs crosswise to the display electrodes, and phosphor layers disposed between the barrier ribs. The rear panel is split into a plurality of areas along the direction parallel to the data electrode, the barrier ribs are formed for each of the split areas, and an alignment mark for position aligning is provided simultaneously with the data electrode in a place out of the display region on the splitting border, and an insulation layer which covers the data electrode on the rear panel is provided with a cut to have the alignment mark disclosed.

The present invention helps implementing a larger-size panel maintaining a certain specific display image quality over the entire split areas.

REFERENCE MARKS IN THE DRAWINGS

1 Front Panel
1*a*, 2*a* Alignment Mark
2 Rear Panel
2*b* Splitting Border
3 Front Substrate
4 Scan Electrode
4*a*, 5*a* Transparent Electrode
4*b*, 5*b* Bus Electrode
5 Sustain Electrode
6 Dielectric Layer
7 Protective Layer
8 Rear Substrate
9 Insulation Layer
9*a* Cut
10 Data Electrode
10*a* Interconnect Electrode
11 Barrier Rib
12 Phosphor Layer
13 Light Blocking Layer

DETAILED DESCRIPTION OF PREFERRED EMBODIMENT EXEMPLARY EMBODIMENT

A plasma display panel in accordance with an exemplary embodiment of the present invention is described below with reference to FIG. 1 through FIG. 8. It is to be noted that scope of the present invention is not limited by the descriptions of embodiments in the following.

Figure 1:
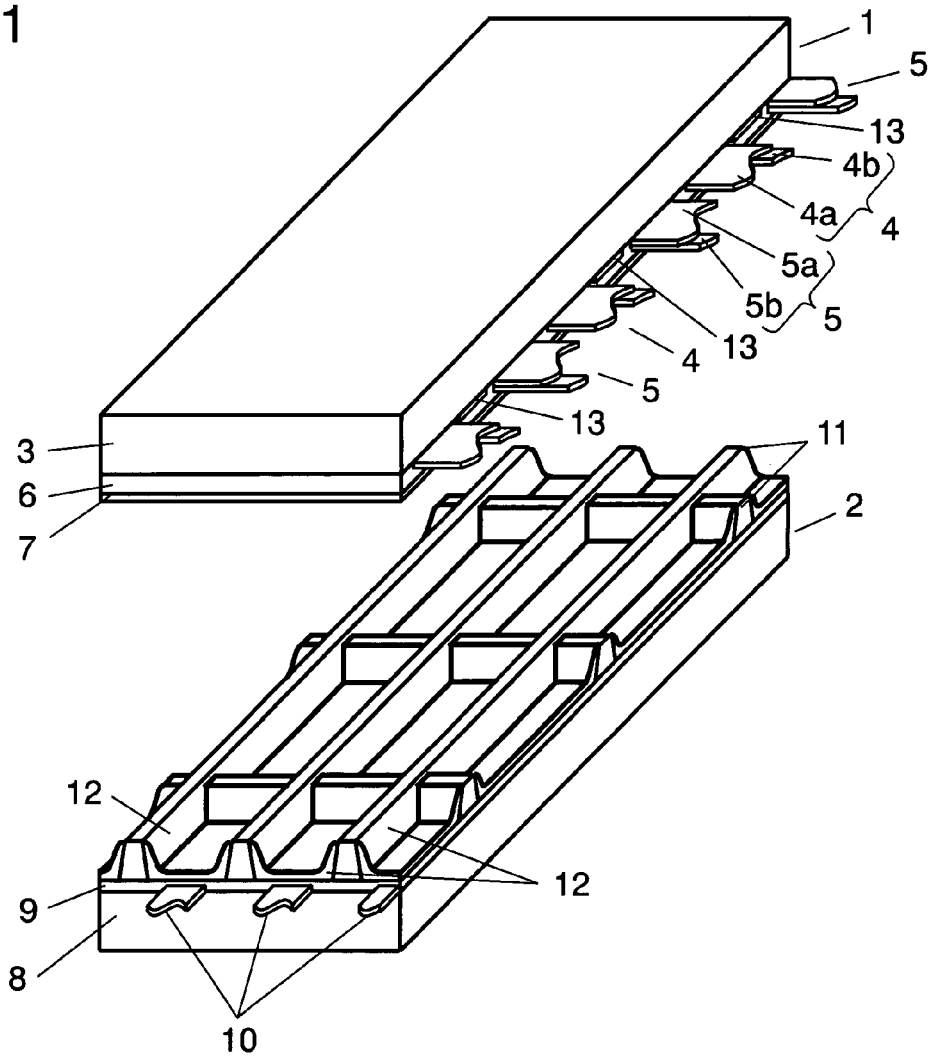
FIG. 1 is a perspective view which shows the key portions of panels for a plasma display panel in accordance with an exemplary embodiment of the present invention.

First, the structure of plasma display panel is described referring to FIG. 1.

FIG. 1 is a perspective view of the key portion of panel which is used for a plasma display panel in accordance with an exemplary embodiment of the present invention. As illustrated in FIG. 1, a plasma display panel is formed of front panel 1 and rear panel 2. Front panel 1 and rear panel 2 are disposed opposed to each other so as a discharge space is formed in between the panels, and the panels are sealed together in the circumference with a sealing material (not shown) made of a glass frit. The discharge space is filled with a discharge gas, which is a mixed gas of neon and xenon, for example.

Front panel 1 has front substrate 3 made of a glass; on the surface of which substrate, scan electrode 4, or a first electrode, and sustain electrode 5, or a second electrode, are provided opposed in parallel to each other offering a discharge gap in between. Thus a couple of display electrodes are provided, and the couple of display electrodes are disposed in a plurality of columns. Scan electrode 4 and sustain electrode 5 are covered with dielectric layer 6 made of a glass material, further on dielectric layer 6 protective layer 7 which is made of MgO is formed. Scan electrode 4 and sustain electrode 5 are formed, respectively, of transparent electrode 4*a*, 5*a* made of ITO (Indium Tin Oxide) and bus electrode 4*b*, 5*b* made of Ag or the like conductive material overlaid on transparent electrode 4*a*, 5*a*.

Rear panel 2 has rear substrate 8 made of a glass material disposed opposed to front substrate 3. On the surface of which rear substrate, a plurality of data electrodes 10 made of Ag or the like conductive material are provided covered by glass insulation layer 9. Further on the insulation layer 9, barrier ribs 11 are provided in parallel crosses for dividing a discharge space formed with respect to the front panel 1, and phosphor layers 12 of red, green and blue are provided between the barrier ribs 11. Address electrode 10 is provided on rear panel 2 between the barrier ribs 11 crosswise to scan electrode 4 and sustain electrode 5 of front panel 1. Discharge cells are formed at respective cross points of data electrode 10 and scan electrode 4, sustain electrode 5.

Further provided between scan electrode 4 and sustain electrode 5 on front panel 1 is black-colored light blocking layer 13 for enhancing the contrast.

It is to be noted that the panel structure is not limited to the one described in the above. For example, the barrier ribs may be provided instead in a stripe arrangement; scan electrode 4 and sustain electrode 5 may be disposed in the sequence of scan electrode 4-sustain electrode 5-sustain electrode 5-scan electrode 4, . . . , instead of the alternating arrangement shown in FIG. 1, viz. scan electrode 4-sustain electrode 5-scan electrode 4-sustain electrode 5 . . . .

Figure 2:
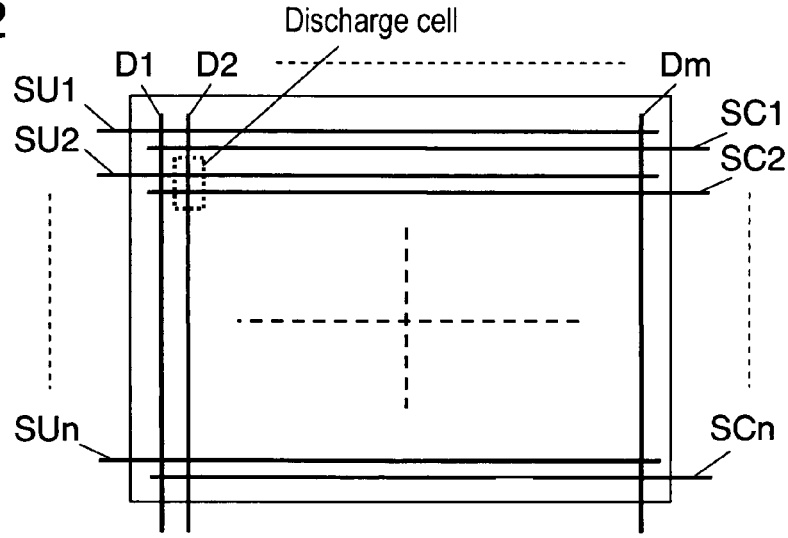
FIG. 2 shows the arrangement of electrodes in a plasma display panel in an exemplary embodiment of the present invention.

FIG. 2 shows arrangement of electrodes in a panel of plasma display panel in accordance with an exemplary embodiment of the present invention. In FIG. 2, scan electrodes SC1-SCn (scan electrode 4 of FIG. 1) and sustain electrodes SU1-SUn (sustain electrode 5 of FIG. 1) are provided for n columns each, while data electrodes D1-Dm (data electrode 10 of FIG. 1) for m rows. A discharge cell is formed at the cross point of data electrode Dj (j=1–m) and the pair of scan electrode SCi and sustain electrode SUi (i=1–n). Thus, number of the discharge cells in discharge space is m×n units.

Figure 3:
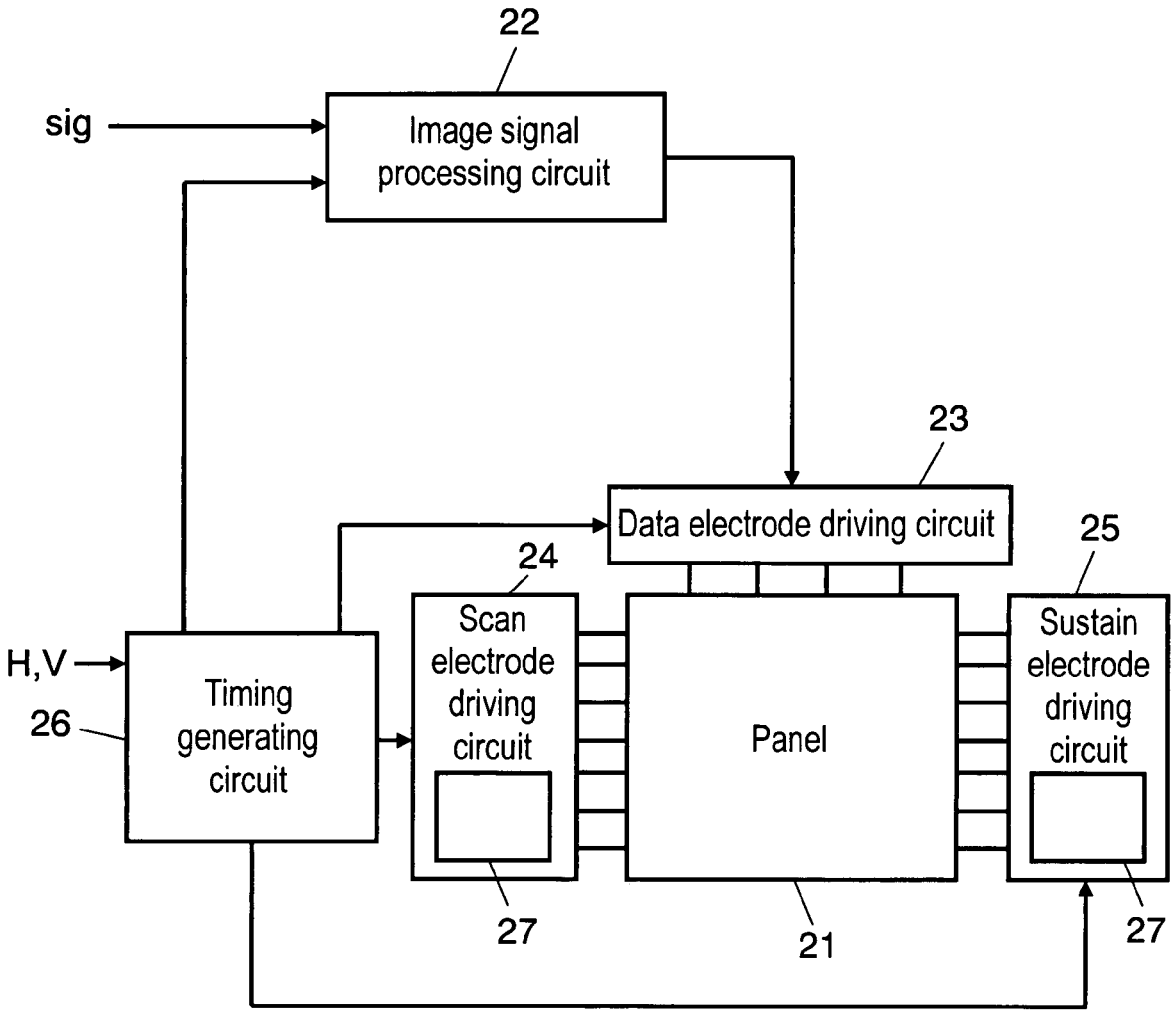
FIG. 3 is a circuit block diagram of a plasma display apparatus for driving a plasma display panel in accordance with an exemplary embodiment of the present invention.

FIG. 3 is a circuit block diagram for a plasma display panel in accordance with an exemplary embodiment of the present invention, which panel being incorporated in a plasma display apparatus. Referring to FIG. 3, the plasma display apparatus includes panel 21, image signal processing circuit 22, data electrode driving circuit 23, scan electrode driving circuit 24, sustain electrode driving circuit 25, timing generating circuit 26 and a power supply circuit (not shown).

Image signal processing circuit 22 converts an image signal sig to image data of respective sub-fields. Address electrode driving circuit 23 converts the image data of respective sub-fields into signals corresponding to respective data electrodes D1-Dm, and drives data electrodes D1-Dm. Timing generating circuit 26 generates various timing signals based on horizontal synchronous signal H and vertical synchronous signal V, and delivers them to driving circuit blocks. Scan electrode driving circuit 24 delivers driving voltage waveform to scan electrodes SC1-SCn based on timing signal, while sustain electrode driving circuit 25 delivers driving voltage waveform to sustain electrodes SU1-SUn based on timing signal. Both scan electrode driving circuit 24 and sustain electrode driving circuit 25 are provided with sustain pulse generating unit 27.

Now in the following, description will be made on the driving voltage waveform for driving a panel as well as its operation, referring to FIG. 4.

Figure 4:
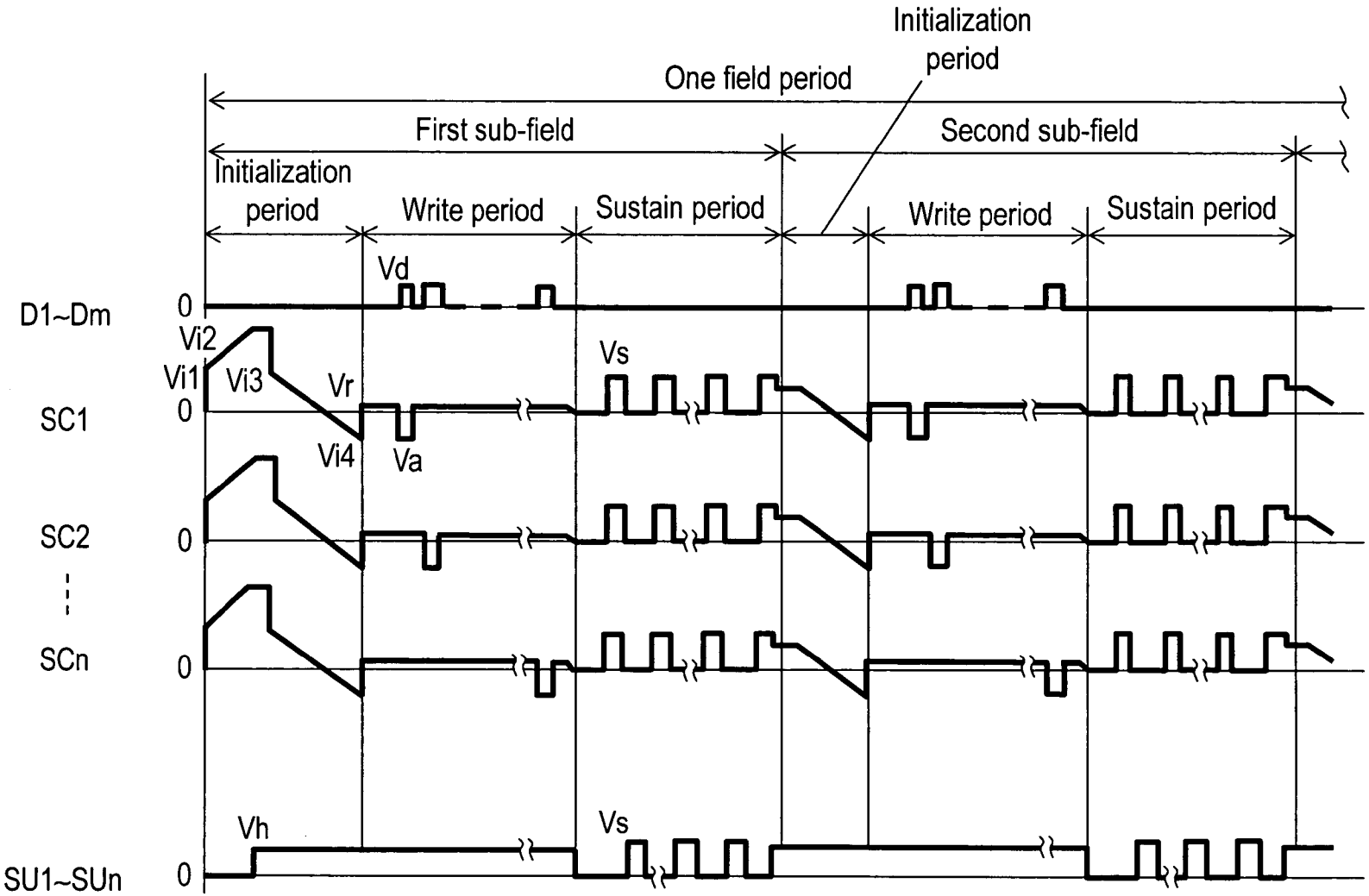
FIG. 4 is a waveform chart showing the driving voltage waveform applied on respective electrodes of a plasma display panel in accordance with an exemplary embodiment of the present invention.

FIG. 4 shows driving voltage waveforms applied to respective electrodes of a plasma display panel in accordance with an exemplary embodiment of the present invention. In a plasma display apparatus in the present embodiment, one field is divided into a plurality of sub-fields, each of the sub-fields having initialization period, write period and sustain period.

Reference is made to FIG. 4, during the initialization period of first sub-field, data electrodes D1-Dm and sustain electrodes SU1-SUn are kept at 0 (V), while scan electrodes SC1-SCn are applied with a slowly ascending ramp voltage from Vi 1 (V) which is a voltage lower than that for starting a discharge, towards Vi 2 (V) which is a voltage higher than that for starting a discharge. Then, a first weak initialization discharge is caused with all of the discharge cells; a negative wall voltage is accumulated on scan electrodes SC1-SCn while a positive wall voltage is accumulated on sustain electrodes SU1-SUn and data electrodes D1-Dm. The wall voltage on electrodes here means a voltage caused by wall charges accumulated on dielectric layer covering the electrode, phosphor layer, etc.

And then, scan electrodes SC1-SCn are applied with a slowly descending ramp voltage from voltage Vi 3 (V) to voltage Vi 4 (V), while maintaining sustain electrodes SU1-SUn at positive voltage Vh (V). Then, all the discharge cells exhibit a second weak initialization discharge; the wall voltage between scan electrodes SC1-SCn and sustain electrodes SU1-SUn is weakened, also wall voltage on data electrodes D1-Dm is adjusted to a level that is suitable to a write operation.

In the succeeding write period, scan electrodes SC1-SCn are once held at Vr (V). Then, the first column scan electrode SC1 is applied with negative scan pulse voltage Va (V), while data electrode Dk (k=1–m), among data electrodes D1-Dm of discharge cells to be displayed at the first column, is applied with a positive write pulse voltage Vd (V). When, a voltage at the crossing of data electrode Dk and scan electrode SC1 becomes to be the sum of wall voltage on data electrode Dk and wall voltage on scan electrode SC1 added on external application voltage (Vd–Va), which is higher than a discharge starting voltage. Write discharge starts between data electrode Dk and scan electrode SC1, as well as between sustain electrode SU1 and scan electrode SC1; a positive wall voltage is accumulated on scan electrode SC1 of the discharge cell, while a negative wall voltage is accumulated on sustain electrode SU1, and on data electrode Dk, either.

Thus, write discharge is caused at the discharge cell to be displayed among those in the first column, which means a write operation in which the wall voltage is accumulated on respective electrodes. On the other hand, voltage at the crossing of scan electrode SC1 and data electrodes D1-Dm on which no write pulse voltage Vd (V) was applied does not go beyond the discharge starting voltage; so, no write discharge takes place there. The above write operation is repeated one after the other until it reaches a discharge cell at the n-th column. This completes the write period.

In the succeeding sustain period, scan electrodes SC1-SCn are applied with a first voltage, or positive sustain pulse voltage Vs (V), while sustain electrodes SU1-SUn are supplied with a second voltage, or the ground potential 0 (V). When, in the discharge cell which exhibited the write discharge, voltage between scan electrode SCi and sustain electrode SUi becomes the sum of wall voltage on scan electrode SCi and wall voltage on sustain electrode SUi added on sustain pulse voltage Vs (V), which means that it is higher than discharge start voltage. Scan electrode SCi and sustain electrode SUi start making sustain discharge, and phosphor layer is excited by the discharged ultraviolet ray and emits light. A negative wall voltage is accumulated on scan electrode SCi, while a positive wall voltage is accumulated on sustain electrode SUi, and on data electrode Dk, either.

In the discharge cell which did not exhibit write discharge during the write period, sustain discharge is not caused, and the wall voltage at the end of initialization period is maintained. Next, scan electrodes SC1-SCn are applied with a second voltage, or 0 (V), while sustain electrodes SU1-SUn are applied with a first voltage, or sustain pulse voltage Vs (V). Then, voltage between sustain electrode SUi and scan electrode SCi exceeds the discharge starting voltage in the discharge cell which caused sustain discharge, and sustain electrode SUi and scan electrode SCi again start making sustain discharge. A negative wall voltage is accumulated on sustain electrode SUi, while a positive wall voltage on scan electrode SCi.

In the same manner as described in the above, by applying sustain pulses alternately on scan electrodes SC1-SCn and sustain electrodes SU1-SUn for a number corresponding to the brightness weight, the sustain discharge continues in the discharge cell which caused the write discharge during write period. Thus, the sustain operation for sustain period completes.

Operations at initialization period, write period and sustain period in the succeeding sub-field remain substantially the same as those in the first sub-field. So, description on which is eliminated.

Figure 5:
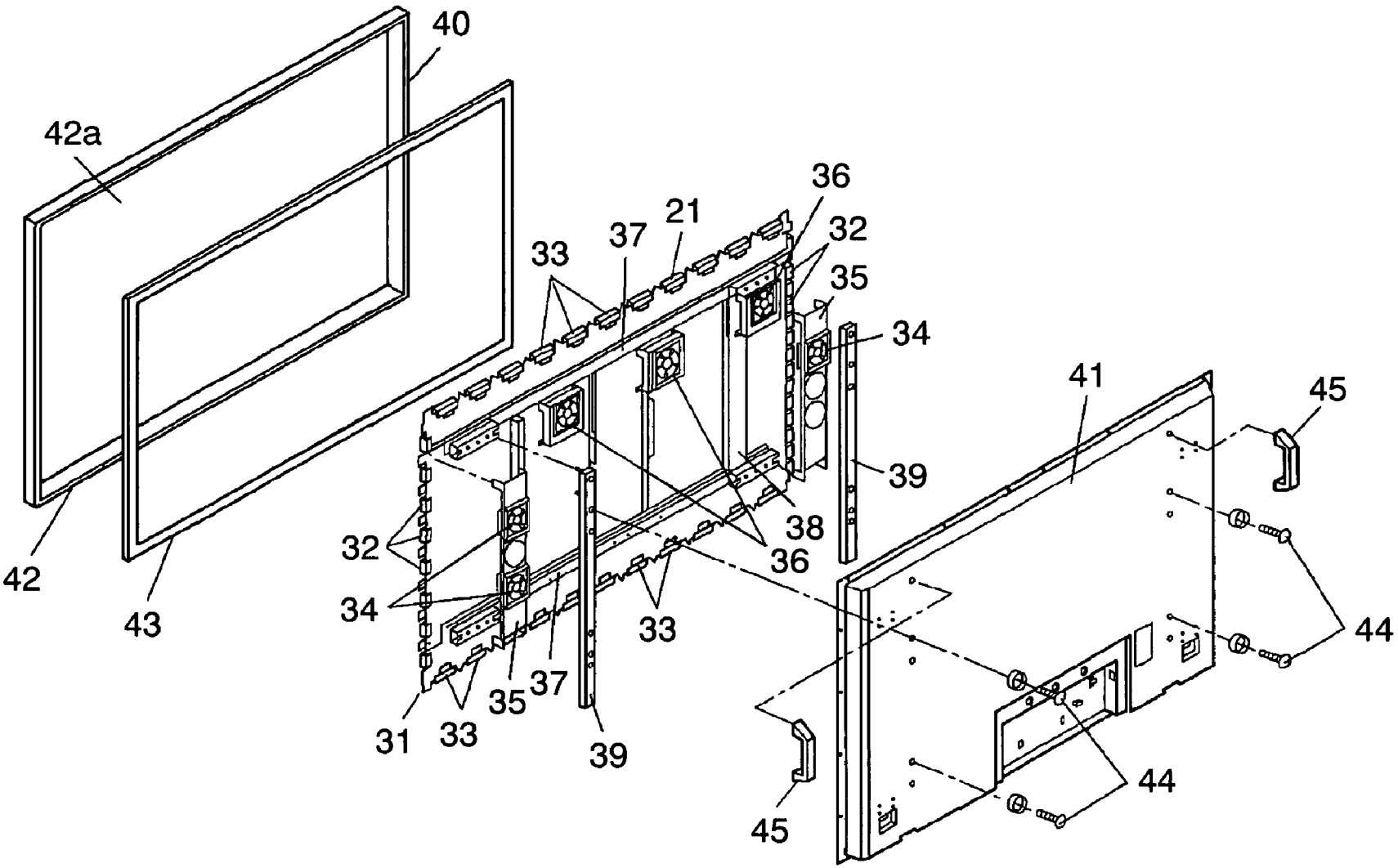
FIG. 5 is an exploded perspective view showing the overall structure of a plasma display apparatus which contains a plasma display panel in accordance with an exemplary embodiment of the present invention.

FIG. 5 is an exploded perspective view showing the total structure of a plasma display apparatus which includes a plasma display panel in accordance with an exemplary embodiment of the present invention. Referring to FIG. 5, chassis 31 made of aluminum or the like metal is for holding components, at the same time for dissipating heats. Panel 21 is affixed to the front of chassis 31 using an adhesive or other means, with a heat dissipating sheet (not shown) in between. Behind chassis 31, a plurality of driving circuit blocks (not shown) for driving panel 21 are disposed. Thus a module is formed.

The heat dissipating sheet, which has a thickness of 1 mm-2 mm, is used for gluing panel 21 to the front of chassis 31 and for conveying the heat generated at panel 21 efficiently to chassis 31 for dissipation. An electrically-insulating sheet made of a synthetic resin material such as an acrylic, urethane and silicone resin, rubber, etc. mixed with filler for enhancing the heat conductivity may be used for the heat dissipating sheet. A graphite sheet, a metal sheet, etc. may also be used instead for the purpose. There can be variations in the heat dissipating sheet; if the sheet is provided with an adhesive property, panel 21 can be affixed to chassis 31 with the sheet alone; if the sheet has no adhesive property, a both-faced adhesive tape may be used together with the sheet for affixing panel 21 to chassis 31.

Panel 21 is provided at both sides with flexible wiring board 32, which is coupled with leads of scan electrode 4 and sustain electrode 5 and works as wiring member for the display electrodes. Wiring board 32 is bent at the outer circumference of chassis 31 to the behind, and connected to a driving circuit block of scan electrode driving circuit 24 and a driving circuit block of sustain electrode driving circuit 25, via a connector.

In addition, Panel 21 is provided at the top and the bottom edges with a plurality of flexible wiring boards 33, which are coupled with leads of data electrode 10 and works as wiring member for the data electrodes. Flexible wiring board 33, which is electrically connected with respective address drivers of data electrode driving circuit 23, is brought to the behind of chassis 31 via outer circumferential edge to be electrically connected to a driving circuit block of data electrode driving circuits 23 placed at the bottom and the top of chassis 31.

Cooling fan 34 which is held by angle member 35 is provided in the neighborhood of driving circuit block. Cooling fan 34 is designed so that the air flow cools the driving circuit block. In addition, cooling fan 36 is provided at the upper part of chassis 31 for three units. These cooling fans 36 are designed to cool the driving circuit block of data electrode driving circuit 23 placed at the upper location, and to cause an upward air flow for cooling the inside of the whole apparatus from the bottom behind panel 21.

Chassis 31 is provided with reinforcement angles 37 and 38 disposed in the horizontal direction and vertical direction, respectively. Stand pole 39 for holding an apparatus upright is screwed to horizontal angle 37.

A module of the above configuration is housed in a cabinet, which cabinet having protective front cover 40 for protecting panel 21 at the front and back cover 41 made of a metal material disposed behind chassis 31. A finished plasma display apparatus is offered in this way.

Protective front cover 40 is formed of front frame 42 made of resin, metal, etc. which has opening 42*a* for exposing the front image display region of panel 21 to the front, and protection panel 43 made of a glass sheet, etc. to be fit in opening 42*a*, which panel containing an optical filter and a radiation suppression film for suppressing unwanted radiation of electromagnetic wave. Protection panel 43 is mounted to front frame 42, with circumferential part of the panel being pressed to the frame edge of opening 42*a* by means of a press metal (not shown). Back cover 41 is provided with a plurality of ventilation holes (not shown) for discharging the heat generated from the module.

In FIG. 5, back cover 41 is screwed to chassis 31 using screws 44, and handles 45 are screwed to back cover 41.

Now, description will be made in the following on the featuring structure of the present invention which helps implementing a larger-size plasma display panel.

Among the processes used for producing many kinds of constituent components of a plasma display panel, an exposure process is used for forming a pattern on a layer of photo-sensitive material provided on a substrate, in which process the photo-sensitive layer is exposed via a photo mask having a certain specific pattern. Along with the recent trends towards larger-size display panels, an exposure area would become larger than that an exposure facility can expose. In order to have such a large area exposed, the present invention splits the large exposure area into a plurality of small areas.

Figure 6A:
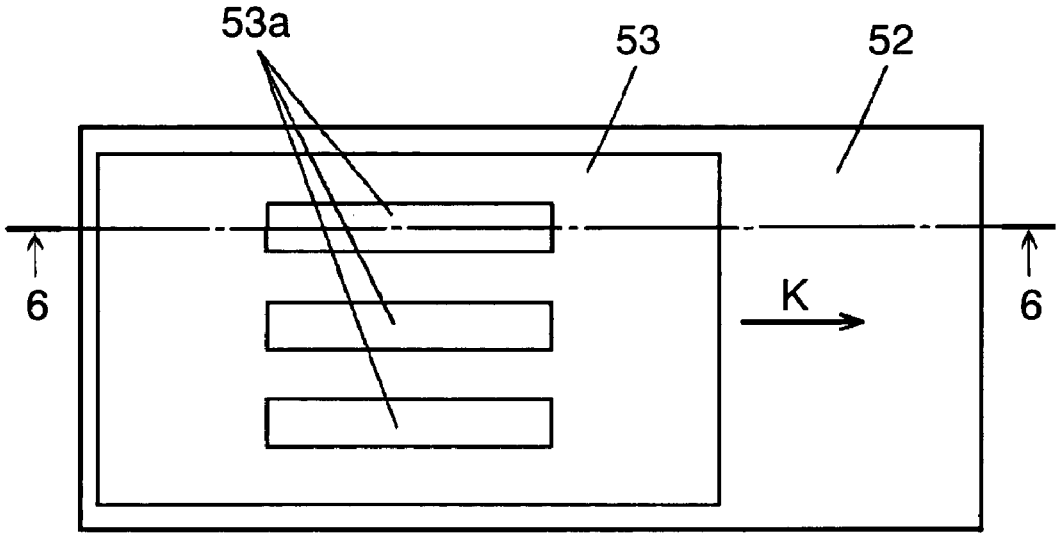
FIG. 6A is a plan view showing the operation of exposing the left area of a substrate using the split exposure method for plasma display panel in accordance with an exemplary embodiment of the present invention.
Figure 6B:
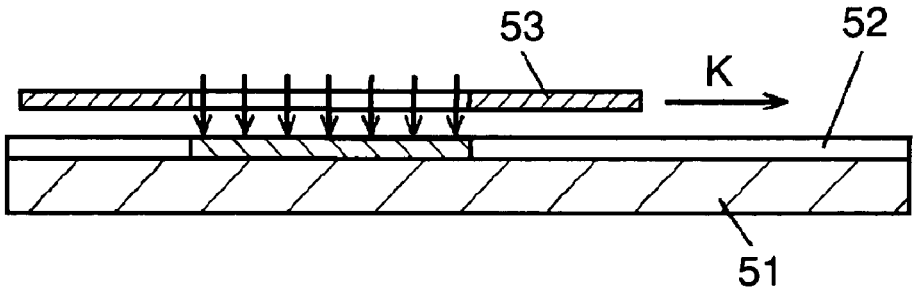
FIG. 6B is a cross sectional view of that shown in FIG. 6A, sectioned along the line 6-6.
Figure 6C:
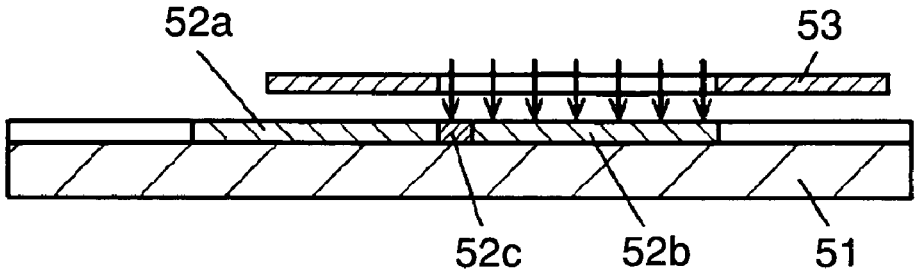
FIG. 6C shows the operation of exposing the right area of the substrate.

FIG. 6A through 6C illustrate the split exposure method for manufacturing a plasma display panel in accordance with an exemplary embodiment of the present invention. The exposure is being made on photo-sensitive layer 52 provided on substrate 51, via photo mask 53.

FIG. 6A is a plan view, where substrate 51 is being exposed at the left area. FIG. 6B is a cross sectional view of FIG. 6A, sectioned along the line 6-6. FIG. 6C is a cross sectional view, where substrate 51 is being exposed at the right area. As shown in FIG. 6A through 6C, photo-sensitive layer 52 of e.g. silver paste is provided on substrate 51 for forming a constituent part of a plasma display panel. Photo mask 53 is disposed above substrate 51 at the left area with a certain specific distance from photo-sensitive layer 52. Photo mask 53 has openings 53*a*.

As shown in FIG. 6A through 6C, the size of substrate 51 is larger in relation to photo mask 53. Therefore, photo mask 53 is shifted to the direction K so that the exposure operation is performed split into twice, one for the left area the other for the right area of substrate 51; thus, the entire area of substrate 51 is exposed. Openings 53*a* are provided for forming the electrode patterns of a plasma display panel. Photo-sensitive layer 52 is exposed through opening 53*a* to a beam of light source (not shown) provided above photo mask 53. Exposure areas 52*a* and 52*b* are at the left and the right of splitting border 52*c*. In the present embodiment, unexposed region of photo-sensitive layer 52 is removed during the following developing process.

Figure 7A:
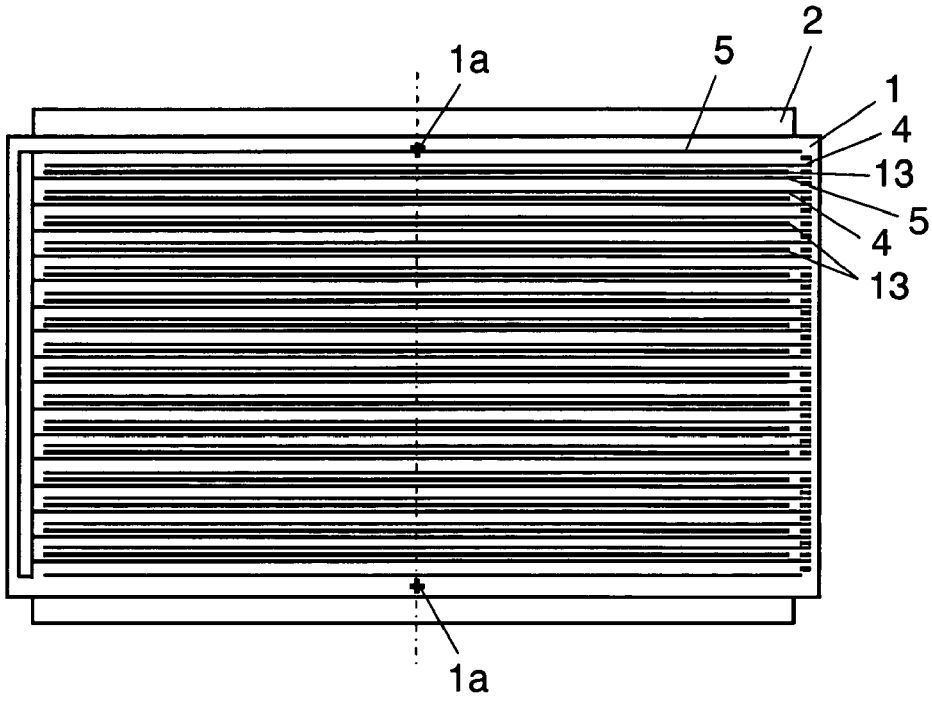
FIG. 7A is a plan view showing the outline structure of a plasma display panel in the present invention, a constituent portion of which panel has been produced in accordance with the split exposure method, as viewed from the front of the panel.
Figure 7B:
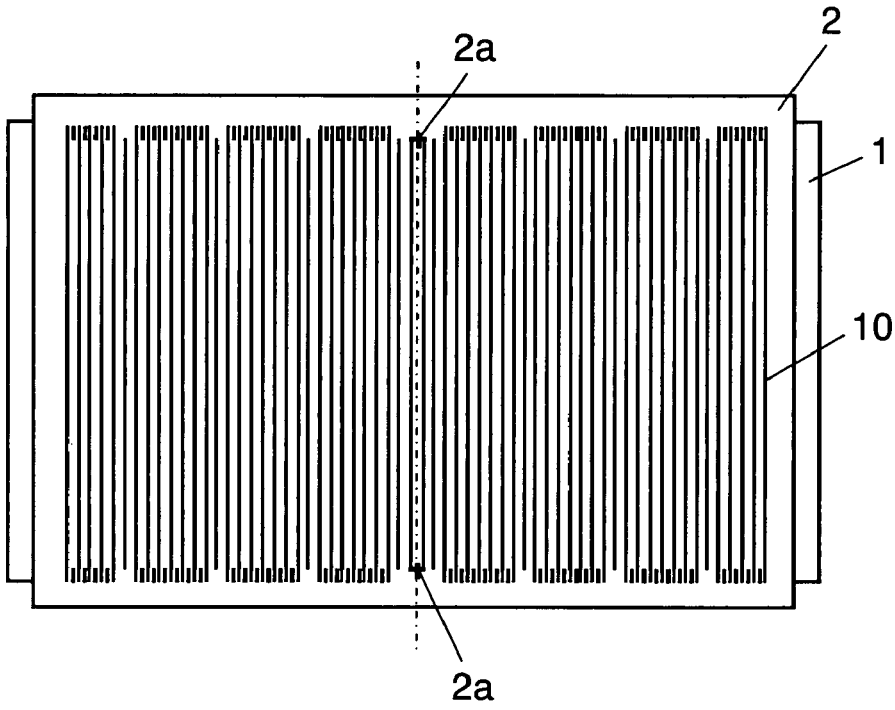
FIG. 7B is a plan view showing the outline structure of a plasma display panel in the present invention, a constituent portion of which panel has been produced in accordance with the split exposure method, as viewed from the behind of the panel.

FIG. 7A is a plan view showing the outline of a plasma display panel whose constituent part has been provided by the split exposure method in accordance with the present invention, as seen from the front panel side. FIG. 7B is a plan view showing the outline of a plasma display panel whose constituent part has been provided by the split exposure method in accordance with the present invention, as seen from the rear panel side.

As shown in FIGS. 7A and 7B, alignment marks 1*a* and 2*a* having the +shape are provided on front panel 1 and rear panel 2, in a place out of the display region at the middle of the upper and the lower edges of the longer sides. When making exposure in accordance with the split exposure method as shown in FIG. 6A through 6C, front substrate 3 and rear substrate 8, which correspond to substrate 51, are aligned with photo mask 53 by making use of these alignment marks 1*a*, 2*a*. Alignment mark 1*a* of front panel 1 is formed with ITO simultaneously when transparent electrodes 4*a*, 5*a* of FIG. 1 are formed on front substrate 3. Alignment mark 2*a* of rear panel 2 formed with Ag or the like conductive material simultaneously when data electrode 10 of FIG. 1 is formed on rear substrate 8.

As described in the above, a constituent part of a plasma display panel can be formed split into a plurality of areas, taking advantage of these alignment marks 1*a*, 2*a*. Since the display image quality can be maintained at a certain specific level over the entire split areas, it helps implementing a panel of larger-size.

In the constituent part of a plasma display panel manufactured using the above-described split exposure method, however, the border area between split areas might be recognized by the eyes of a viewing audience to be unpleasant depending on its form. It may be a degrading factor to the esthetic appearance of a panel in operation or out of operation; this would downgrade the display image quality either. In order to avoid this to occur, a panel in an embodiment of the present invention is structured as shown in FIG. 8.

Figure 8:
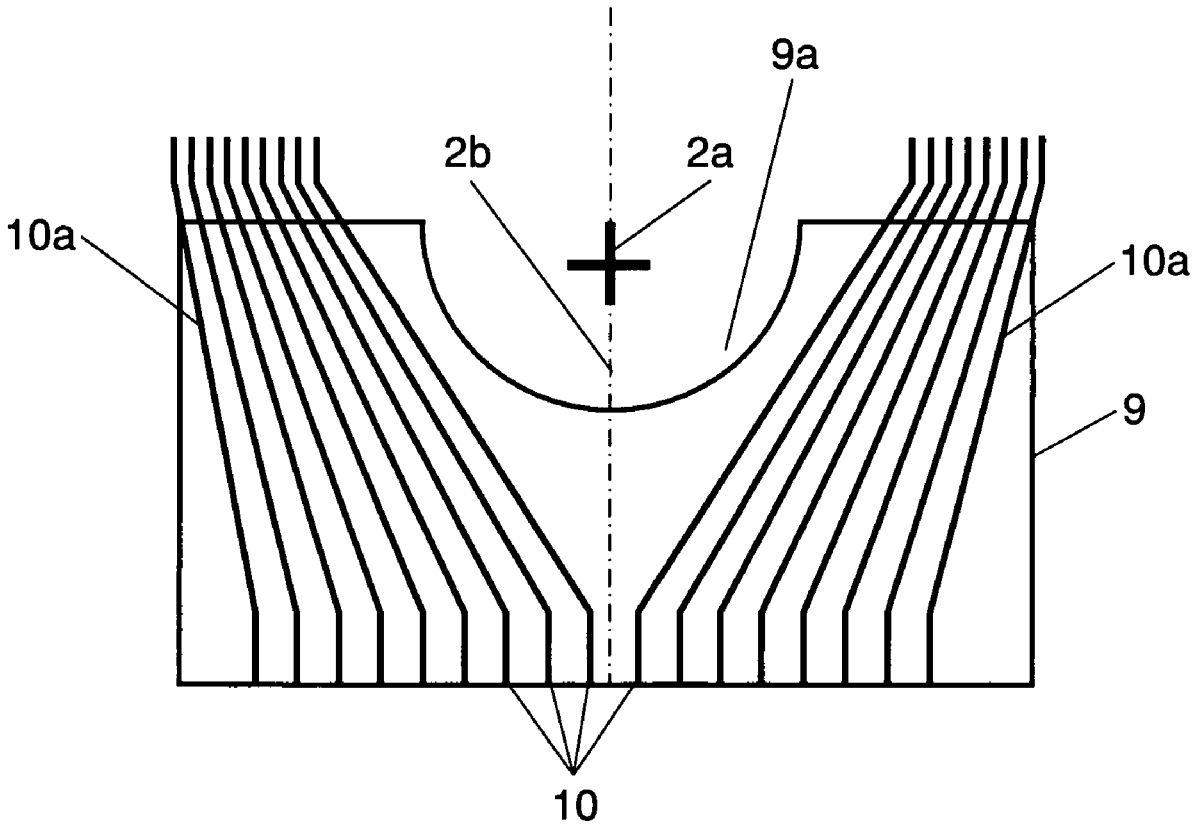
FIG. 8 is a magnified view showing a rear panel in the key part of a plasma display panel in accordance with an exemplary embodiment of the present invention.

FIG. 8 is a magnified view showing a key portion of rear panel used in a plasma display panel in accordance with an exemplary embodiment of the present invention. As indicated in FIG. 8, rear panel 2 in the present invention is split along the direction parallel to data electrode 10 into a plurality of areas (in the drawing, it is split into two areas, the left area and the right area), so that barrier ribs 11 are formed for each of the areas. Rear panel 2 is further provided with alignment mark 2*a* for position aligning formed simultaneously with data electrode 10 in a place out of the display region on splitting border 2*b*, and insulation layer 9 covering data electrode 10 on rear panel 2 is provided with cut 9*a* to have alignment mark 2*a*disclosed.

Interconnect electrodes 10*a* of data electrodes 10 in an embodiment of the present invention are formed split in the left area and the right area of rear substrate 8 with respect to splitting boarder 2*b*, as shown in FIG. 7B and FIG. 8.

As described in the above, in rear panel 2 of a plasma display panel provided in accordance with the split exposure method, where barrier ribs 11 are formed for each of the plural areas split along the direction parallel to data electrode 10, alignment mark 2*a* for position aligning is formed on rear panel 2 simultaneously with data electrode 10 in a place out of the display region on splitting border 2*b*, and insulation layer

9 covering data electrode 10 on rear panel 2 is provided with cut 9*a* to have alignment mark 2*a* disclosed, the constituent part can be formed split into a plurality of areas maintaining a certain specific display image level over the entire spit areas. This helps implementing the panels in larger sizes.

INDUSTRIAL APPLICABILITY

The present invention would be useful for implementing larger-size higher-definition plasma display panels.

The invention claimed is:

1. A plasma display panel comprising:

a front panel having a front substrate, on which display electrodes each having a first electrode and a second electrode are provided opposed with a discharge gap therebetween in a plurality of columns; and a rear panel having a rear substrate disposed opposed to the front substrate, on the rear substrate, barrier ribs being provided for dividing a discharge space formed with respect to the front panel, a data electrodes being provided between the barrier ribs crosswise to the display electrodes, and a phosphor layer being provided between the barrier ribs; wherein, the rear panel is split along a direction parallel to the data electrodes into a left area and a right area, and the barrier ribs are formed for each of the left and right areas, interconnect electrodes of the data electrodes are formed split in the left area and the right area of the rear substrate with respect to a splitting boarder, an alignment mark for position aligning is provided in a position where the interconnect electrodes of the data electrodes are formed split in the left area and the right area, and the alignment mark is provided in a place out of a display region at the splitting border on the rear panel simultaneously with the data electrode, and an insulation layer covering the data electrode of the rear panel is provided with a cut to have the alignment mark disclosed.

2. A plasma display panel comprising:

a front panel having a front substrate;

display electrodes on the front substrate;

a rear panel having a rear substrate opposed to the front substrate, the rear substrate including a left area and a right area meeting at a border;

data electrodes on the rear substrate oriented crosswise to the display electrodes;

an alignment mark located outside of a display region on at least one of the left and right areas at the boarder;

a plurality of interconnect electrodes comprising: interconnect electrodes on the left area of the rear panel and to the left of the alignment mark; and interconnect electrodes on the right area of the rear substrate and to the right of the alignment mark; and an insulation layer, covering the data electrode of the rear panel, including a cut-out around the alignment mark such that the alignment mark is not covered by the insulation layer.

* * * * *